US009653005B2

(12) United States Patent
Hogan

(10) Patent No.: US 9,653,005 B2
(45) Date of Patent: May 16, 2017

(54) ERASABLE LOOP SCHEDULER

(71) Applicant: Richard J. Hogan, Ixonia, WI (US)

(72) Inventor: Richard J. Hogan, Ixonia, WI (US)

( * ) Notice: Subject to any disclaimer, the term of this patent is extended or adjusted under 35 U.S.C. 154(b) by 195 days.

(21) Appl. No.: 14/285,010

(22) Filed: May 22, 2014

(65) Prior Publication Data

US 2014/0346765 A1 Nov. 27, 2014

Related U.S. Application Data

(60) Provisional application No. 61/855,799, filed on May 24, 2013.

(51) Int. Cl.
*G09D 3/00* (2006.01)
*G09D 3/06* (2006.01)

(52) U.S. Cl.
CPC ..... *G09D 3/00* (2013.01); *G09D 3/06* (2013.01)

(58) Field of Classification Search
CPC ..... G09F 3/10; B42D 5/04; B42D 5/048
See application file for complete search history.

(56) References Cited

U.S. PATENT DOCUMENTS 328,939 A * 10/1885 Kletzke ..... B65H 29/16 271/69
646,457 A * 4/1900 O'Marra ..... G09D 3/10 40/118
5,560,127 A * 10/1996 Thomas ..... G09D 3/10 40/118
6,464,571 B1 * 10/2002 Talieh ..... B24B 21/04 451/11
6,877,262 B2 * 4/2005 Bianco ..... G09D 3/10 40/107

FOREIGN PATENT DOCUMENTS

DE 2707665 A * 8/1978 ..... B42D 5/046

* cited by examiner

*Primary Examiner* — Cassandra Davis
(74) *Attorney, Agent, or Firm* — Boyle Fredrickson, S.C.

(57) ABSTRACT

An erasable loop scheduler with a board and a loop system is disclosed. The board has a first and second side, each having a viewing pane that displays a different portion of the loop system. The loop system includes a grid system that can be configured like a calendar. A user can write out a full month of dates and appointments on the first side of the board and another full month of dates and appointments on the second side of the board. Once a row of events has passed, the loop system can be advanced, at which point the row of past events moves to the second side of the board. The user may then erase that row of events and replace with upcoming dates and appointments. Alternatively, the user may keep the row of events for future reference.

4 Claims, 7 Drawing Sheets

ERASABLE LOOP SCHEDULER

CROSS-REFERENCE TO RELATED APPLICATION

This present application claims the benefit of priority of U.S. Provisional Patent Application Ser. No. 61/855,799 filed May 24, 2013, the entire contents of which are hereby expressly incorporated by reference into the present application.

BACKGROUND OF THE INVENTION

1. Field of the Invention

The present invention relates in general to the field of calendars. More particularly, the present invention relates to an erasable loop schedule that allows a user to have a continuous calendar.

2. Discussion of the Related Art

As is known to those skilled in the art, a variety of personal calendars is available that allow a user to keep track of daily appointments. Because of the cycle of a calendar year, a traditional calendar can only be used for one year so that the days of the month will accurately line up. As such, various embodiments of perpetual calendars have been produced such that a user can use the calendar for more than one year's time.

Many perpetual calendars feature a month-long grid. Some configurations allow a user to physically write the days of the week in while others provide spaces that are mechanically moved to change the month and days. An issue with configurations featuring a month-long grid is that a user cannot easily erase portions of the grid without erasing the entire grid. For instance, after a week passes, a user would have to erase the top line of text and copy each row up one line at a time to keep a full upcoming months appointments visible. Additionally a user who decides to go though the tedious process of erasing and rewriting an upcoming month may later realize that they wish to review a previous week's information. This will be impossible if the schedule has been erased.

Some common perpetual calendars feature a month-long grid with apertures that display the month and the days. This means that the user does not have to write in the month and days when using the perpetual calendar. In operation, however, these types of perpetual calendars often involve complicated mechanical systems that can easily break and are difficult, if not impossible, to fix. Also, these types of calendars only display a month of time and do not allow a user to subsequently look at a past or future month.

What is needed, therefore, is a perpetual calendar that allows a user to view a full month of appointments without having to continuously rewrite portions of the schedule to keep a full month's information. Further, what is also needed is a perpetual calendar that can display more than a single month of time, for instance, a calendar that can keep record of previous appointments or schedule additional appointments in the future.

SUMMARY AND OBJECTS OF THE INVENTION

By way of summary, the present invention is directed to an erasable loop scheduler. A primary object of the invention is to provide an apparatus that allows for continuous use of a calendar. One aspect of the apparatus is a board with at least one viewing pane. A second aspect of the apparatus is a loop system that wraps around the board such that the loop system can continually be looped around the board. A third aspect of the apparatus is a grid system in conjunction with the loop system, with at least a portion of the grid system displayed through the at least one viewing pane of the board. The apparatus includes a means for advancing the loop system.

The grid system can have a number of configurations, for instance a calendar. Similarly, the grid system may have seven rows across by five rows high. The grid system could also be seven rows across by three rows high through ten rows high. The grid system may be printed on a flexible plastic band that can be written on with an erasable medium. A user can then write dates in the grid system to correspond with the days of a month.

The board may have a first viewing pane on a first side and a second viewing pane located on a second side opposite the first side. The first viewing pane can display a first portion of the grid system, for instance, a first month, and the second viewing pane can display a second portion of the grid system, for instance, a second month. For instance, the first viewing pane can display a current month, and the second viewing pane can display a previous month. This allows a user to review previous appointments and events. Alternatively, the first viewing pane can display a current month, and the second viewing pane can display an upcoming month. This allows the user to review two months of upcoming events.

The board may also include a plurality of mounting holes. For instance, the mounting holes may be configured such that the board can be mounted within a three-ring binder. Alternatively, the holes may be configured to allow the board to be mounted to a wall.

Another object of the invention is to provide a method of using an erasable loop scheduler. First, a user will write the dates on a transparent overlay that wraps around a board and covers a first side and a second side of the board. Beneath the transparent overlay is a grid system. Once the corresponding days of the month are written onto the overlay, the user writes appointments corresponding to the appropriate dates. Next, the user grasps the transparent overlay and slides it along the board once a horizontal row of dates has passed.

The method may continue as the user flips the board over. On the opposite side of the board, a second portion of the grid system is viewable that includes previously-recorded information that has been slid from the first side of the board to the second side of the board. The user can erase expired dates and appointments when desired and write new dates and appointments on the erased portion of the grid system.

Another object of the invention is to provide an erasable loop scheduler with a board with a first viewing pane and a second viewing pane, a grid system, and a means of advancing the grid system. The grid system is on a flexible loop system that is fitted around the board. As a result, the first viewing pane displays one side of the grid system and the second viewing pane displays a second side of the grid system. The erasable loop scheduler can be advanced such that the user may reposition the grid system to view upcoming dates in the first viewing pane, and past dates are repositioned to be viewed in the second viewing pane.

The flexible loop system may be made of a plastic material. The grid system itself may be configured like a calendar, for example, a calendar for one complete month. Ideally, the grid system will have a plurality of cells that does not contain any written material.

The erasable loop scheduler may include picture-hanging hardware such that the calendar can be hung up. Alternatively, the erasable loop scheduler may include magnets such that it can be mounted to magnetic items.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
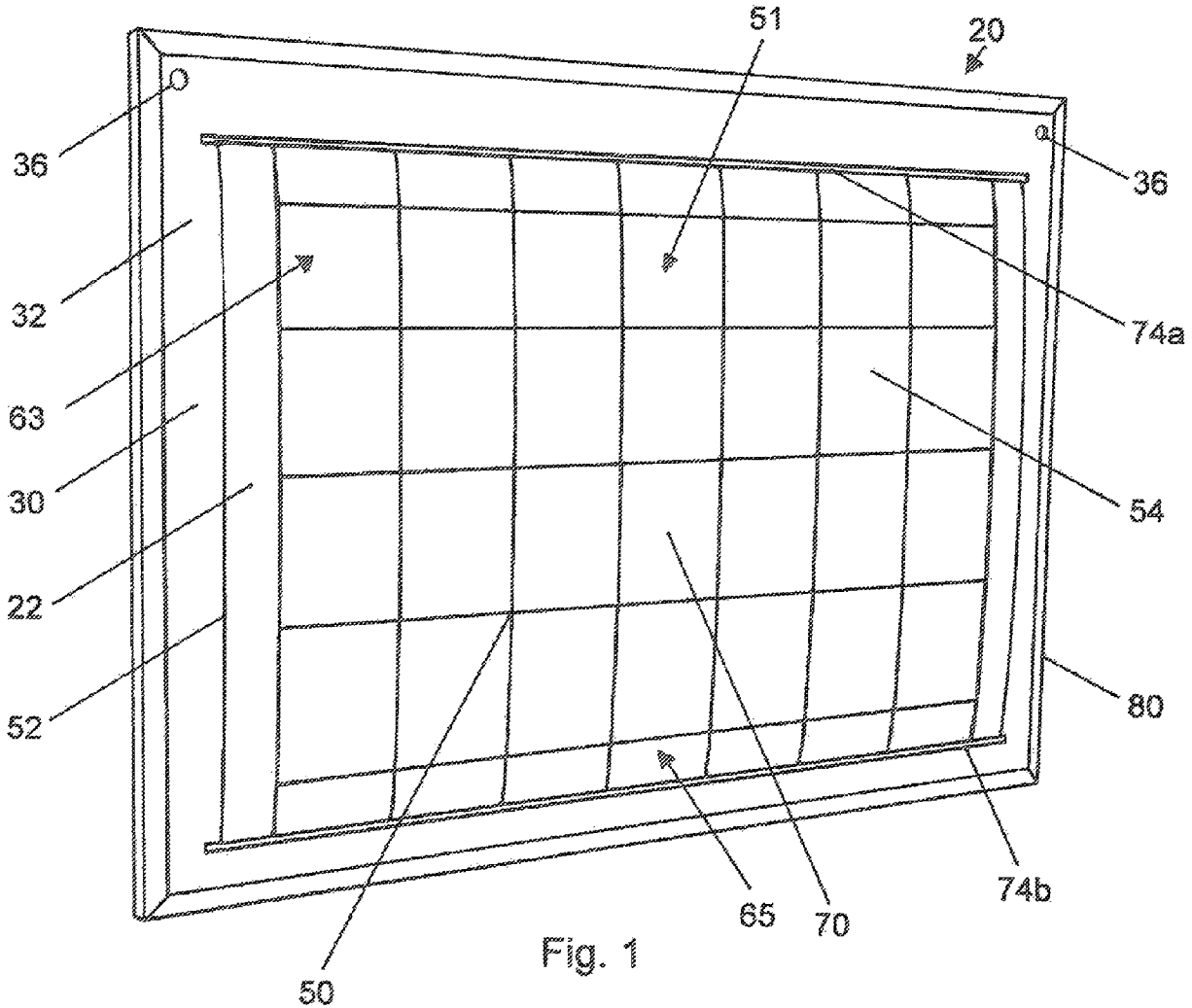
FIG. 1 illustrates a perspective view of an erasable loop scheduler of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected", "attached", or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. System Overview

The proposed invention is an erasable loop scheduler stretched over a rigid board to create a rotating writing surface that is an improvement over existing dry/wet erasable white board calendars currently on the market. The prior art includes other perpetual calendars that use a continuous loop or belt. The prior art uses a belt with printed number and names of the months that are mechanically rotated or cycled to appear through apertures in the writing surface. The purpose of this is to save the user the task of writing and rewriting the dates and months on a dry erase calendar. The proposed invention uses the loop or belt as the writing surface without numbers or months. This means that the scheduled information is rotated and does not include any preprinted information. Additionally, the proposed invention can be much simpler in operation, as it can be operated in one embodiment with no mechanics whatsoever, but rather is rotated manually using only a user's fingers.

The erasable loop scheduler consists of a smooth surfaced plastic loop stretched loosely over a rigid board, allowing the loop to rotate freely as the user sees fit. The rigid board can be made of cardboard, wood, plastic, metal or any combination thereof. The board may include a frame made of any number of materials. The board may have holes, hooks, magnets, or other mounting mechanisms to hang the scheduler on a variety of surfaces according to the size and style of the erasable loop scheduler. The loop is made of an erasable smooth-surfaced flexible plastic or similar material. By making the surface out of a flexible loop or belt of erasable plastic, the information on the surface can be shifted so the user does not have to rewrite the information as the weeks progress. A grid system is printed on the flexible loop or belt dividing the surface into cells, with the most common configuration being that of a calendar. If used as a calendar, once the current week at the top is finished, the loop is shifted upward bringing the new week to the top and thus still having at least a month's worth of weeks still in view. This saves the user time by not having to rewrite three to four weeks of data to be able to utilize the whole calendar. This also eliminates errors that may occur in the rewriting process. The scheduler may also be mounted to the wall or other objects, such as a refrigerator. Operating the scheduler is done by pivoting the unit away from the wall on the hooks or, in the case of magnetic mounting, removing it from a steel surface, i.e., a refrigerator, and shifting the loop in the desired direction by the operator's fingers.

Another benefit is that the user has the option of retaining the old information rather than erasing it once the old information moves to the second side. As the information is rotated to the back of the calendar, the user need only flip it over and consult the past week's notations. Alternatively, the user has the option of doubling the time to schedule out. In this case, the user flips the calendar over to use the second side for a future month's scheduling. For example, the front displays the month of March and the second displays the month of April. When hinged at the top, as it would be hanging on hooks, the scheduler could be flipped such that the written information is shown upright. When the loop is shifted to the first side, however, the information would be displayed right side up.

2. Detailed Description of Preferred Embodiments

Referring, initially to FIG. 1, a perpetual calendar comprising an erasable loop scheduler 20 is provided. The erasable loop scheduler 20 has a board 30 that is substantially flat and rigid. As such, the board 30 has a first side 32 and a second side 34, each of which can be viewed by flipping the board 30 over. The first side 32 has a viewing pane 70 through which material mounted to the board 30 can be viewed. The second side 34 may have a second viewing pane 72 that can display additional information. The erasable loop scheduler 20 can be dimensioned such that it is small and portable such that it can be easily transported.

Figure 3:
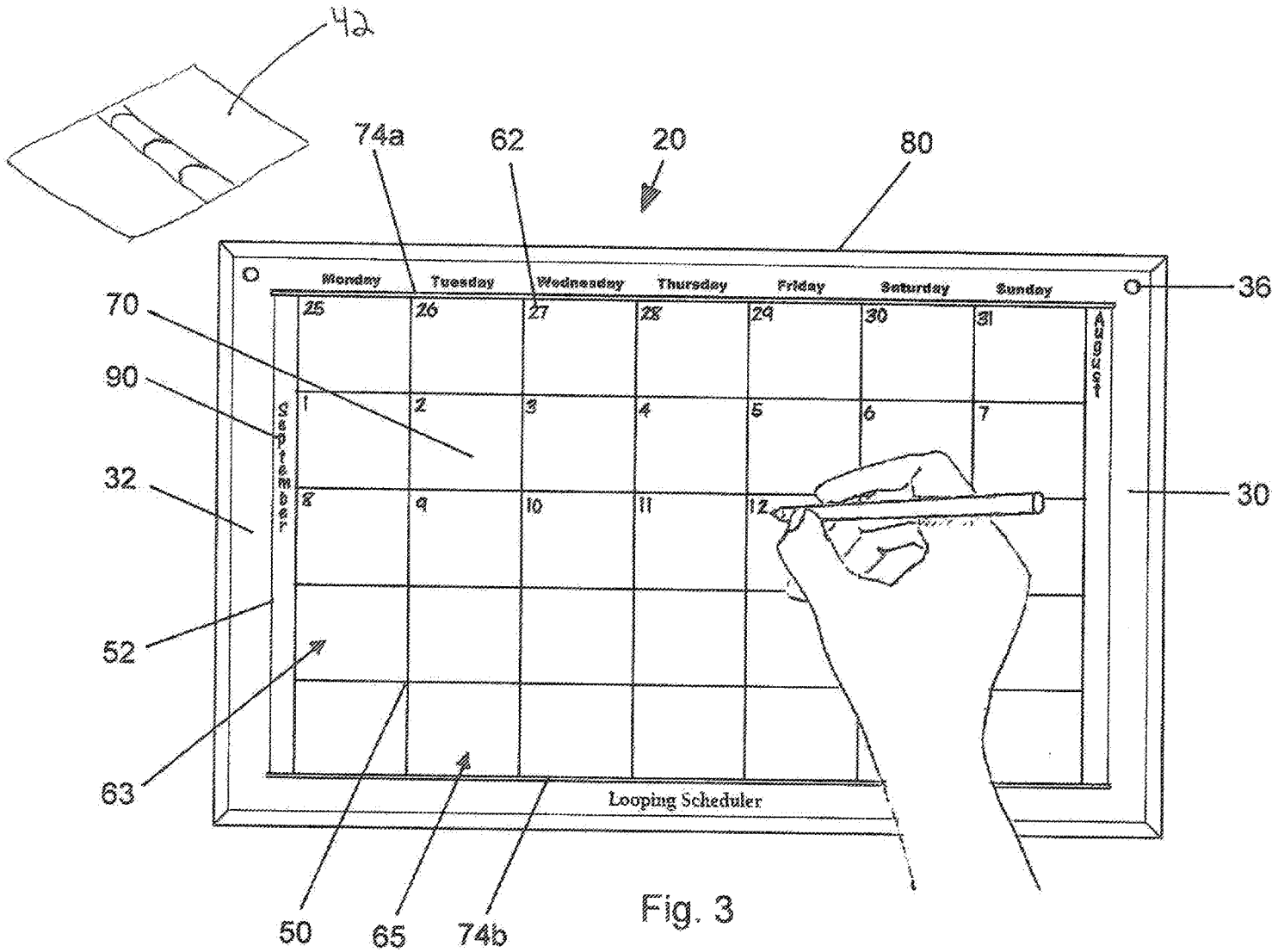
FIG. 3 illustrates a front elevation view of the erasable loop scheduler of FIG. 1 where a user is writing in dates.
Figure 6:
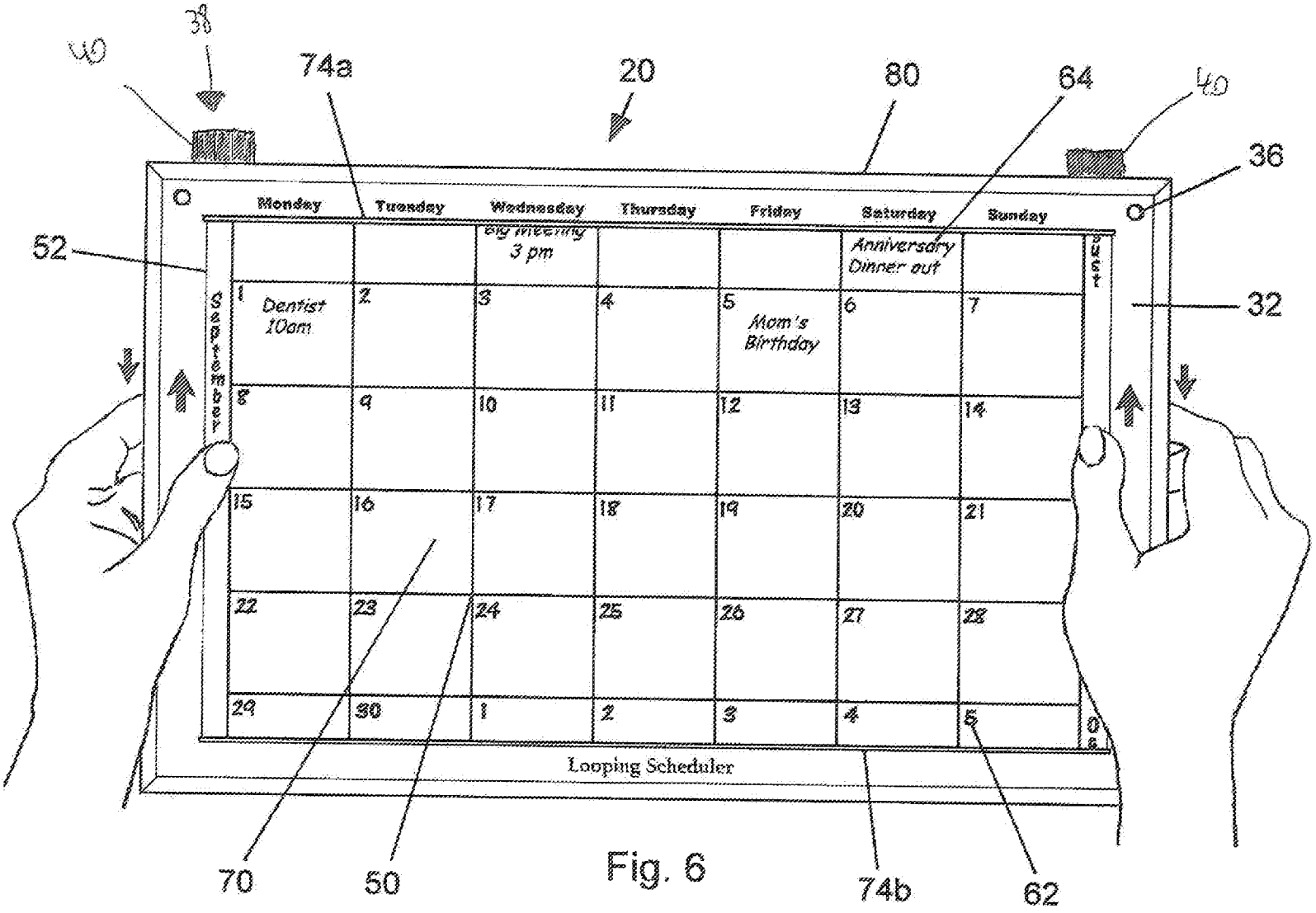
FIG. 6 illustrates a front elevation view of the erasable loop scheduler where a user slides the loop so that a new row of information is viewable on the first side.

Alternatively, the erasable loop scheduler 20 may be large and configured to hang on a wall. In any configuration, the erasable loop scheduler 20 may include any number of ways to mount the board 30 to a wall or other object. For instance, the board 30 may have mounting holes 36 that allow the erasable loop scheduler 20 to be secured. In one such configuration, the mounting holes 36 may be configured to fit into a standard three-ring binder 42 as shown in FIG. 3. Alternatively, the mounting holes 36 may be used to attach the erasable loop scheduler 20 to a wall. Also, the board 30 may have a mounting system 38 such as picture-hanging hardware that allows the erasable loop scheduler 20 to be hung like a picture as can best be seen in FIG. 6. For instance, the mounting system 38 could be any combination of hooks, adhesive, or any other picture-hanging hardware as known in the art. As shown in FIG. 6, magnets 40 may also be used to attach the erasable loop scheduler 20 to other materials. The erasable loop scheduler 20 may also have an outer frame 80 connected to the board 30 for increased aesthetic appeal and overall strength to the erasable loop scheduler 20.

Figure 2:
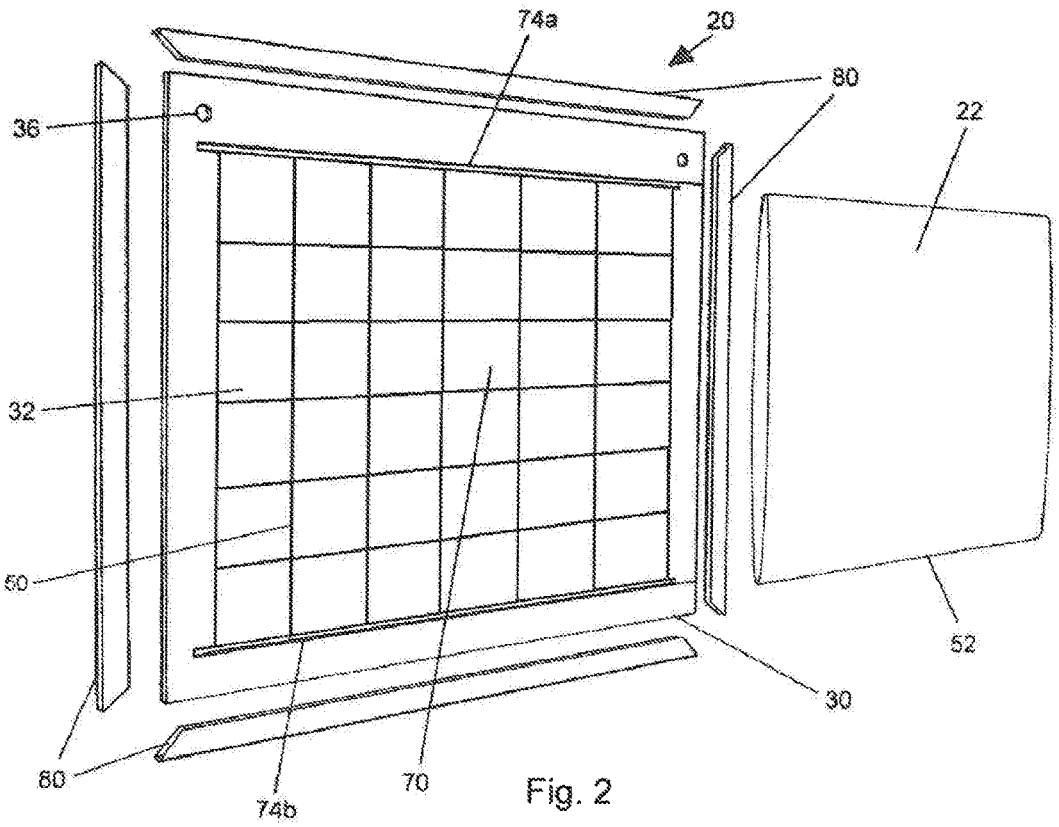
FIG. 2 illustrates an exploded view of the erasable loop scheduler of FIG. 1.

A loop system 52 wraps around the board 30 as can best be seen in FIG. 2, which shows an exploded view of the erasable loop scheduler 20. Preferably, the loop system 52 is made of a flexible material. The loop system 52 should be tight fitting but movable around the board 30. For instance, the loop system 52 can be slid around the board 30 by a user's fingers. Alternatively, cranks, knobs, or motorized devices can be used to advance the loop system 52 about the board 30. Because the loop system 52 is continually movable about the board 30, a user can perpetually use the same loop system 52 to record information.

Still looking to FIG. 2, the loop system 52 may be a flexible plastic band which has a grid system 50 printed onto the loop system 52. Alternatively, the loop system 52 may be made of a grid system 50 printed on standard paper and then laminated or covered in a transparent overlay 22 made of flexible, plastic material. In either configuration, the outer surface of the loop system 52 may accept an erasable medium 60 for instance ink. This allows for continued use of the same grid system 50. Preferably, the grid system 50 consists of a plurality of vertical and horizontal lines that creates a number of cells 51, similar to that of a traditional calendar. For instance, the grid system 50 could have seven vertical columns 65 to represent the seven days of the week. Additionally, the grid system 50 can have a number of horizontal rows 63, for instance, five rows 63 for one month, or ten rows 63 for two months. Other variations on the number of rows 63 could used to allow for smaller, more portable versions of the erasable loop scheduler 20, for instance, three rows 63.

To collapse the erasable loop scheduler 20 from the exploded view, the loop system 52 can be threaded through two openings 74*a*, 74*b* that allow for easy movement of the loop system 52 about the board 30. The frame 80 is then attached to the board 30.

Figure 4:
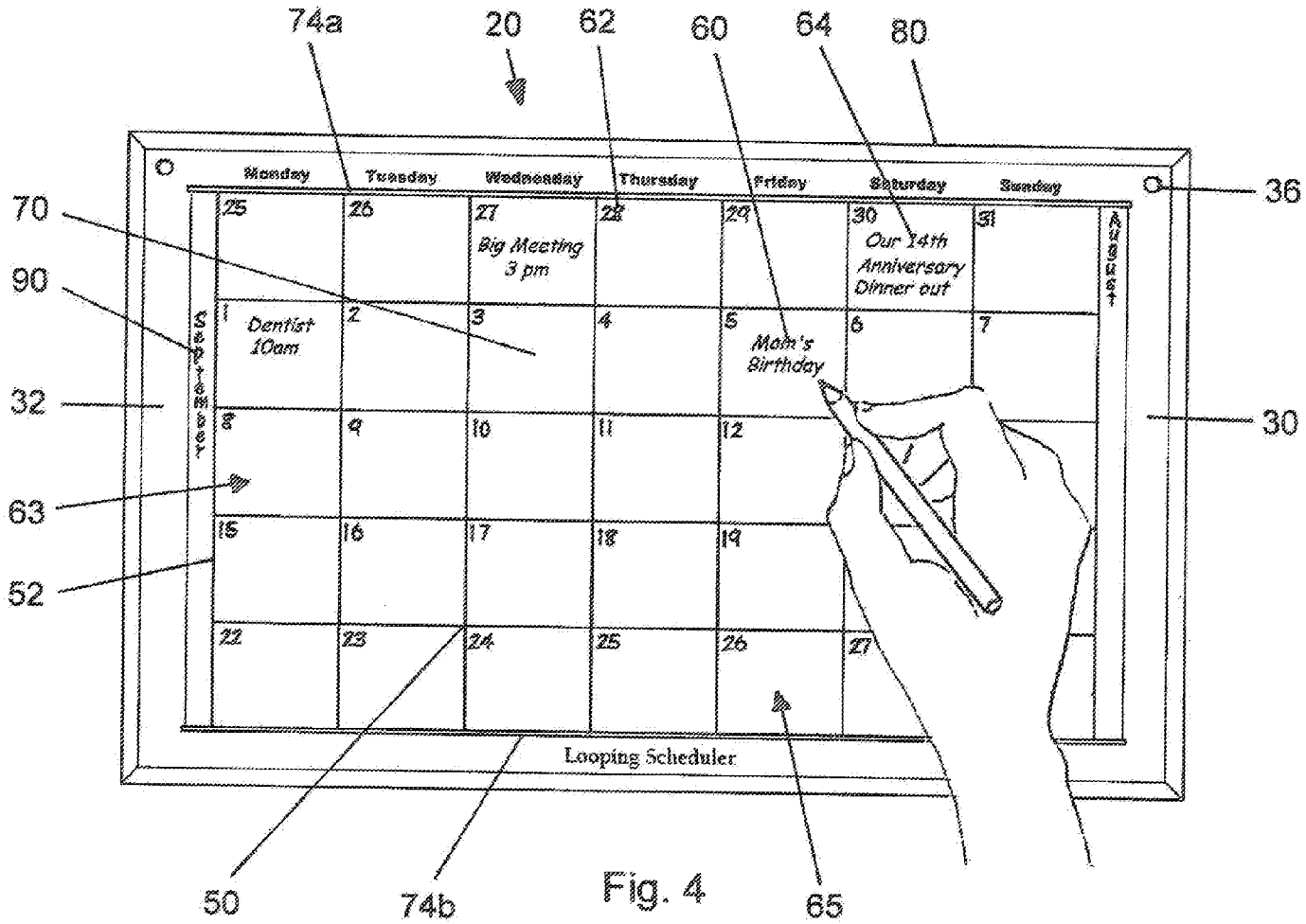
FIG. 4 illustrates a front elevation view of the erasable loop scheduler of FIG. 3 where a user is writing in appointments.

In operation, a first portion 54 of the grid system 50 of the erasable loop scheduler 20 is displayed on the first side 32 of the board 30, as can best be seen in FIG. 3. For instance, the first portion 54 of the grid system 50 may be a first month 90. As shown, the user will write dates 62 on the grid system 50. More specifically, the dates 62 should be written onto the loop system 52 on which the grid system 50 is printed. A first month 90 of dates 62 will be recorded on the grid system 50 located on the viewing pane 70 of the first side 32 of the board 30. All information written onto the grid system 50 will ideally be in an erasable medium, for instance, erasable ink. Next, a user can write corresponding appointments 64 onto the grid system 50 displayed on a viewing pane 70 of the first side 32 of the board 30 as shown in FIG. 4.

Figure 5:
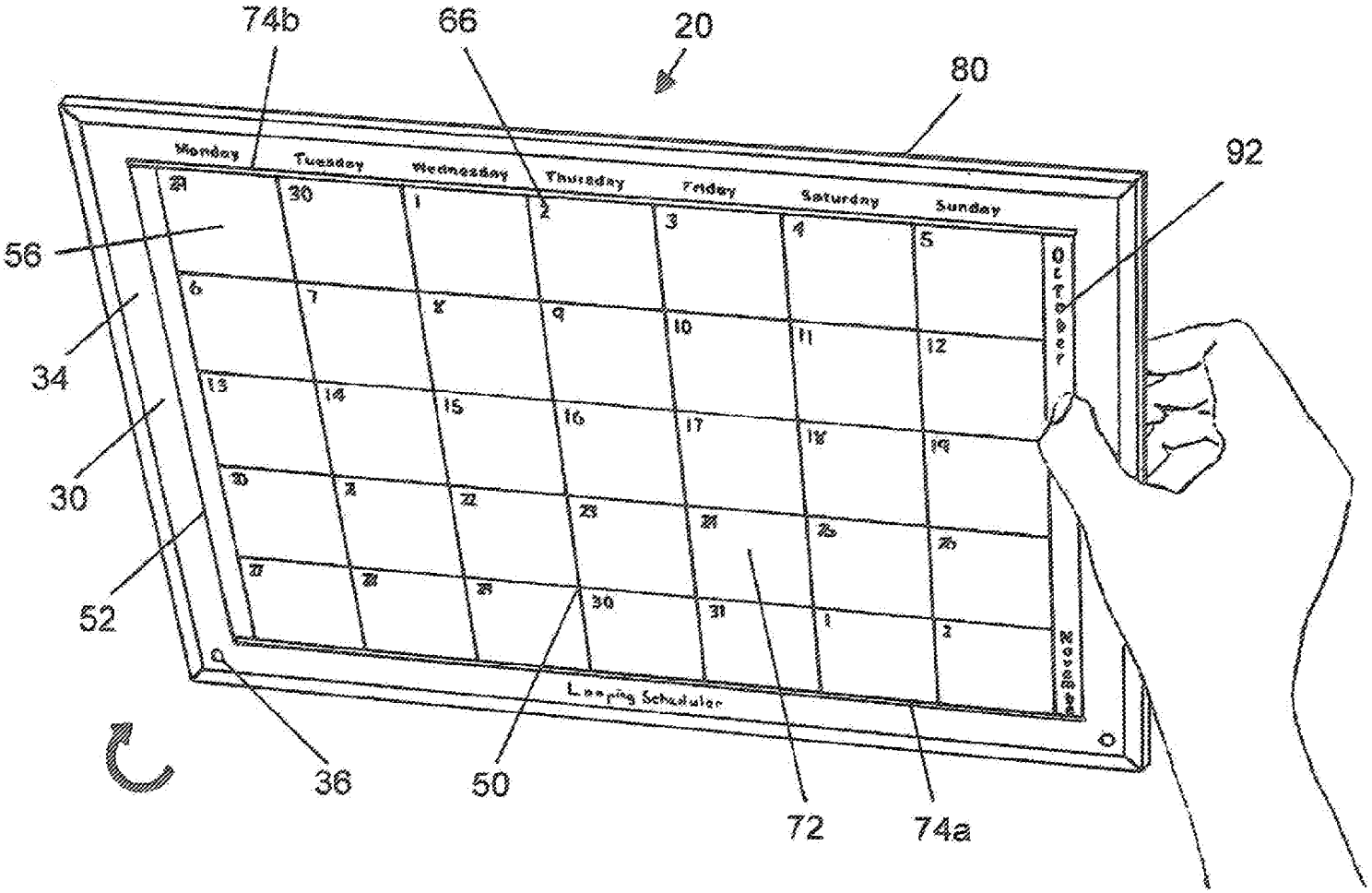
FIG. 5 illustrates a perspective view of the erasable loop scheduler when the scheduler has been flipped to a reverse side.

The board 30 can be flipped over, as best seen in FIG. 5, to display a second side 34 of the board 30 that has a second portion 56 of the grid system 50, for instance, a second month 92. This allows a user to write corresponding dates 62 and appointments 64 onto the second viewing pane 72 of the grid system 50 on the second side 34 of the board 30. The user can use the two-month display system in a number of ways. For instance, the first side 32 of the board 30 can be used to display an upcoming month, and the second side 34 of the board 30 can display a previous month. This allows a user to review previous appointments 64 and events after they have passed. Alternatively, the first side 32 of the board 30 can display an upcoming month, and the second side 34 of the board 30 can display a following month. This allows the user to review two months of upcoming events. Once a user no longer needs a row 63 of previously recorded information 66, its contents may be erased and replaced with an upcoming week of material.

FIG. 6 illustrates one means for advancing the grid system 50 about the erasable loop scheduler. Once a row 63 of dates 62 has passed on the first side 32 of the board 30, the user may grasp the edges of the loop system 52 and slide the loop system 52 such that the row 63 of past dates 62 is moved from the first side 32 of the board 30 to the second side 34 of the board 30 through the opening 74*a*. In turn, the top row from the second side 34 of the board 30 will be moved from the second side 34 of the board 30 to the first side 32 through the opening 74*b*. The configuration of the openings 74*a*, 74*b* in conjunction with the loop system 52 allows the loop system to continually be advanced from the first side 32 of the board 30 to the second side 34 or from the second side 34 to the first side 32. Alternative means of advancing the grid system 50 could also be employed, for instance, use of knobs, cranks, motorized devices, or other means that would be known in the art. This allows a user to always keep a full month of upcoming dates 62 available on the first side 32 of the board 30. The user can then flip the board 30 over and view the second portion 56 of the grid system 50. The user may either keep the row 63 of past dates 62 for future review, or erase the row 63 and replace it with an upcoming week of dates 62.

Figure 7:
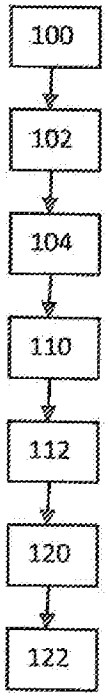
FIG. 7 illustrates a method of using the erasable loop scheduler.

Additionally, a method of using the erasable loop scheduler 20 is provided in FIG. 7. The first step is writing dates on a transparent overlay that wraps around a board that covers a first side and a second side of the board, the transparent overlay having a grid system beneath 100. Next, a user writes appointments corresponding to the appropriate dates on the transparent overlay 102. The transparent overlay can then be grasped and slid around the board when a horizontal row of dates has passed 104. In certain configurations, the board can then be flipped over 110. A second portion of the grid system can be observed which may contain previously recorded information that has been slid from the first side of the board to the second side of the board 112. At this point, the user can keep past appointments or erase them 120. If erased, the user may then write in new dates and appointments on the erased portions of the grid system 122.

Although the best mode contemplated by the inventor of carrying out the present invention is disclosed above, practice of the present invention is not limited thereto. It will be manifest that various additions, modifications, and rearrangements of the features of the present invention may be made without deviating from the spirit and scope of the underlying inventive concept.

For example, the grid system could be advanced by any number of ways. For instance, knobs, pulleys, or other devices could be used. Similarly, although plastic is the preferred material for the loop system, any material could be used in its place. In addition, the individual components need not be fabricated from the disclosed materials but could be fabricated from virtually any suitable materials.

Moreover, the individual components need not be formed in the disclosed shapes or assembled in the disclosed configuration, but could be provided in virtually any shape and assembled in virtually any configuration. For instance, calendars of varying shapes and sizes could be used, including miniature calendars that can it in a user's pocket or larger calendars that allow for further planning beyond a two month system. Furthermore, all the disclosed features of each disclosed embodiment can be combined with, or substituted for, the disclosed features of every other disclosed embodiment, except where such features are mutually exclusive.

It is intended that the appended claims cover all such additions, modifications, and rearrangements. Expedient embodiments of the present invention are differentiated by the appended claims.

What is claimed is:

1. A method of using an erasable loop scheduler comprising:

writing dates on a transparent overlay with a grid system beneath that wraps around and covers a first side and a second side of a board;

writing appointments corresponding to a plurality of appropriate dates on the transparent overlay;

grasping the transparent overlay and sliding it vertically around the board when a horizontal row of dates has passed; and flipping the board over; and observing a portion of the grid system with previously recorded information that has been slid from the first side of the board to a second side of the board.

2. The method of claim 1, further comprising the steps of:

erasing expired dates and appointments; and writing new dates and appointments on an erased portion of the grid system.

3. The method of claim 1 further comprising the step of:

wrapping the transparent loop overlay around the board, wherein the board has the grid system formed thereon.

4. The method of claim 1 further comprising the step of:

wrapping a grid system around the board.

* * * * *